US005522094A

United States Patent [19]

Balazs

[11] Patent Number: 5,522,094

[45] Date of Patent: Jun. 4, 1996

[54] WATER PLUNGER FOR CLEARING CLOGGED DRAINS

[76] Inventor: Louis F. Balazs, 1322 Union Ave., Newburgh, N.Y. 12550

[21] Appl. No.: 179,262

[22] Filed: Jan. 10, 1994

[51] Int. Cl.[6] ..... E03D 9/00

[52] U.S. Cl. ..... 4/255.02

[58] Field of Search ..... 4/255.01–255.12; 604/228

[56] References Cited

U.S. PATENT DOCUMENTS

| | | | |
|---|---|---|---|
| 630,718 | 8/1899 | Kosiol | 4/255.02 X |
| 674,297 | 5/1901 | Kosiol | 4/255.02 X |
| 766,734 | 8/1904 | Schellhammer | 4/255.02 |
| 1,110,189 | 9/1914 | Dodge | 604/228 |
| 1,684,880 | 9/1928 | Norton . | |
| 2,697,842 | 12/1954 | Meyer | 4/255 |
| 3,934,280 | 1/1976 | Tancredi | 4/255.02 |
| 4,057,050 | 11/1977 | Sarstedt | 604/228 X |
| 4,445,236 | 5/1984 | Naddlny et al. | 4/255 |
| 4,542,543 | 9/1985 | Irwin | 4/255.02 |
| 4,566,139 | 1/1986 | Jeng | 4/255 |
| 4,847,923 | 7/1989 | Huang | 4/255.03 |

FOREIGN PATENT DOCUMENTS

| | | | |
|---|---|---|---|
| 0005695 | of 1909 | United Kingdom | 4/255.02 |

*Primary Examiner*—Charles E. Phillips

[57] ABSTRACT

A plunger for clearing a drain pipe, the drain pipe terminating in a drain fitting, the plunger including an elongated cylinder having a first end and a second end, an elongated chamber disposed within the elongated cylinder, a piston disposed within the elongated chamber, a piston handle attached to the piston and projecting from a first end of the elongated cylinder, the piston being slidable in a reciprocal fashion within the elongated chamber by movement of the piston handle, a channel extending from the elongated chamber to the second end of the elongated cylinder, the channel terminating in an opening provided in the second end of the elongated cylinder, the opening being of a substantially smaller transverse dimension than the elongated chamber, the channel tapering inward as it extends from the elongated chamber to the opening, and a collar member substantially surrounding the opening, the collar member including a substantially flexible material.

6 Claims, 2 Drawing Sheets

WATER PLUNGER FOR CLEARING CLOGGED DRAINS

BACKGROUND

1. Field of the Invention

The present invention relates to the field of devices for clearing clogged drains, most particularly devices that are hand operated and exert pressure on the obstruction.

2. Description of the Related Art

U.S. Pat. No. 4,566,139 relates to a piston plunger having a suction cup and a handle with a piston positioned inside. When the handle is pressed downward, the air trapped beneath the suction cup can escape upward through a vent provided into the handle, forcing the piston upward. The piston eventually drops down under its own weight, and the trapped air escapes through a vent in the handle.

U.S. Pat. No. 4,445,236 relates to a reversible plunger and pump apparatus that includes a vacuum cup positioned at one end of a handle and a reversible electric driven pump that operates through the suction cup.

U.S. Pat. No. 2,697,842 relates to a combination hand and air force pressure pump and plunger which includes a piston positioned within a cylinder having a plunger bell reversibly mounted on one end thereof and couplings for optional connection to a pressurized air source.

U.S. Pat. No. 1,684,880 relates to a combined suction and force pump designed for cleaning stop drains, bowls, and toilets that includes a hand operated piston positioned within a handle portion having a flexible bell shaped sealing cup and integral sleeve secured thereto.

SUMMARY OF THE INVENTION

The clogging of drain pipes is a common problem. The most common resorted to implement for clearing a clogged drain is the so-called "plumbers helper," a hemispherical suction cup having a protruding handle. However, this type of tool often produces insufficient force to dislodge a stubborn clog, and the use of harsh chemicals is often resorted to, or a plumber might be brought in to employ a snake or other tools and methods.

One object of the present invention is the provision of a water plunger that can be used by the average person to clear relatively stubborn clogs from drains.

Another object of the invention is the provision of such a water plunger that can often dispense with the need to use harsh chemicals, or to employ a plumber.

Yet another object of the invention is the provision of a water plunger that in simple in construction and operation and, therefore, inexpensive to manufacture.

In one aspect, the invention generally features a water plunger, the water plunger including: an elongated chamber; a piston slidingly disposed within the elongated chamber for reciprocal movement therewithin; a handle attached to the piston, the handle extending outward from a first end of the elongated chamber; an opening in a second opposite end of the elongated chamber; and a collar surrounding the opening, the collar having an exterior surface that tapers inward as it extends away from the second opposite end of the elongated chamber.

Preferably, the collar includes a substantially flexible material; the collar includes an elastomeric material; the water plunger additionally includes a channel extending from the chamber to the opening, the channel including a narrowing taper as it extends from the chamber to the opening; the channel includes a first channel portion having a substantially cylindrical channel wall and a second channel portion having a substantially conically tapered channel wall, the first channel portion extending inward from the opening, and the second channel portion extending inward from the first channel portion to the chamber; the elongated chamber is disposed within a piston cylinder, the piston cylinder including: a first substantially cylindrical section; a second substantially cylindrical section; the first substantially cylindrical section having a substantially greater diameter than the second substantially cylindrical section; and a radially inward tapering section disposed between the first substantially cylindrical section and the second substantially cylindrical section; the first substantially cylindrical section surrounding the elongated chamber; the second substantially cylindrical section surrounding the first channel portion having the substantially cylindrical chamber wall; and the radially inward tapering section surrounding the second channel portion having the substantially conically tapered channel wall; and the collar includes a first substantially annular portion and a second substantially conical portion, the first substantially annular portion of the collar at least partially surrounding the second substantially cylindrical section of the piston cylinder, and the second substantially conical portion of the collar extending outward beyond the second substantially cylindrical section of the piston cylinder.

In another aspect, the invention generally features a plunger for clearing a drain pipe, the drain pipe terminating in a drain fitting, the plunger including: an elongated cylinder having a first end and a second end; an elongated chamber disposed within the elongated cylinder; a piston disposed within the elongated chamber; a piston handle attached to the piston and projecting from a first end of the elongated cylinder; the piston being slidable in a reciprocal fashion within the elongated chamber by movement of the piston handle; a channel extending from the elongated chamber to the second end of the elongated cylinder; the channel terminating in an opening provided in the second end of the elongated cylinder; the opening being of a substantially smaller transverse dimension than the elongated chamber; the channel tapering inward as it extends from the elongated chamber to the opening; and a collar member substantially surrounding the opening, the collar member including a substantially flexible material.

Preferably, the collar member includes a substantially annular portion surrounding the second end of the elongated cylinder and the opening provided therein, and an inwardly tapering portion extending outward from the annular portion; the collar member consists essentially of an elastomeric material; the plunger additionally includes at least one air passage extending from the elongated chamber to the first end of the elongated cylinder; and the drain basin fitting includes a drain opening and at least one substantially upstanding peripheral wall surrounding and spaced radially outward from the drain opening, the inwardly tapering portion of the of the collar member terminates in a distal terminal end, the distal terminal end having an outer diameter substantially equal to the diameter of the drain opening, and the outer diameter of the substantially annular portion is substantially equal to he diameter of the at least one substantially upstanding peripheral wall.

In yet another aspect, the invention generally features a plunger for clearing a drain pipe, the drain pipe terminating in a drain basin fitting, the drain basin fitting including a drain opening and at least one substantially upstanding peripheral wall surrounding and spaced radially outward from the drain opening, the plunger including: an elongated cylinder having a first end and a second end; an elongated chamber formed in the elongated cylinder; a piston member disposed within the elongated chamber for reciprocating movement therewithin; a piston handle attached to and extending from the piston member through the first end of the elongated cylinder; a channel extending from the elongated chamber to the second end of the elongated cylinder; the channel including a first channel portion surrounded by a substantially cylindrical peripheral wall and a second channel portion surrounded by a substantially conical peripheral wall, the substantially conical peripheral wall tapering radially inward in the direction of the second end of the elongated cylinder; the first channel portion terminating in an opening provided at the second end of the elongated cylinder; the second channel portion being disposed intermediate between the elongated chamber and the first channel portion; and a collar member, the collar member including a substantially annular shaped portion surrounding the opening and a substantially frustum shaped portion extending outward from the substantially annular shaped portion and terminating in a distal terminal end; the outer diameter of the substantially annular shaped portion being substantially equal to the diameter of the at least one substantially upstanding peripheral wall; the outer diameter of the distal terminal end of the substantially frustum shaped portion being substantially equal to the diameter of the drain opening; and the collar member consisting essentially of a substantially flexible material.

The invention will now be described by way of a particularly preferred embodiment, reference being made to the accompanying drawings, wherein:

DESCRIPTION OF THE PREFERRED EMBODIMENT

Figure 1:
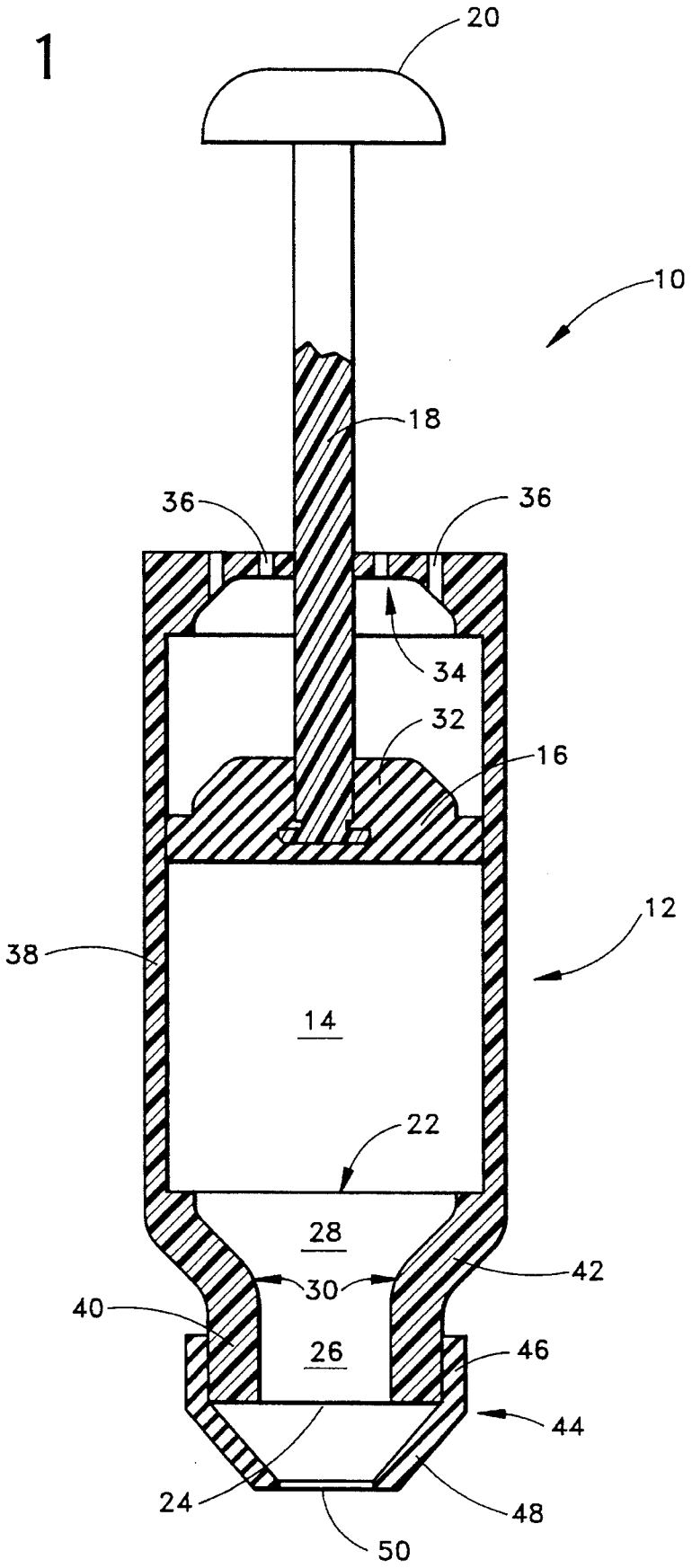
FIG. 1 is a cross sectional elevational view of a water plunger constructed according to the present invention.

Referring initially to FIG. 1, a water plunger 10 constructed according to the present invention generally includes an elongated cylinder 12, an elongated chamber 14 formed within the cylinder 12, a piston 16 slidably positioned within the chamber 14 for reciprocating movement therewithin, and a piston handle 18 that is attached to the piston 16 and that protrudes through a first end of the cylinder 12. The piston 16 is preferably constructed of a material that forms an airtight and watertight seal with the peripheral wall of the chamber 14, for example, a hard rubber (or other semiflexible) material. The distal end of the piston handle 18 is preferably provided with an integrally formed hand hold 20 for providing a comfortable grip for the user.

A channel 22 extends from the chamber 14 to a second opposite end of the cylinder 12 and terminates there in an opening 24. The channel 22 is made up of two portions: a first substantially cylindrically shaped channel portion 26 that extends inward from the opening 24 provided in the second end of the cylinder 12 toward the chamber 14, and a second substantially conically tapered channel portion 28 that is disposed intermediate of and extends between the first channel portion 26 and the chamber 14. The second channel portion 28 is substantially in the shape of an inverted frustum, that is, a truncated cone, and merges into the first channel portion 26 via a preferably smoothly raduised transition section 30. Due to the above-described construction, the channel, composed of the first and second channel portions 26 and 28 presents a narrowing taper as it extends from the chamber 14 to the opening 24. The narrowing taper of the channel raises the velocity of the fluid (e.g., water or air) expelled from the opening 24 and thereby significantly enhances the action of the fluid in unclogging a drain.

As shown in FIG. 1, the upper surface of the piston 16 is preferably provided with an upraised dome structure 32 that mates with a similarly recessed dome structure 34 provided on the interior surface of the first end of the cylinder 12. Additionally, as shown in FIG. 1, the piston handle 18 is preferably attached to the piston 16 by being embedded therein (although other methods of attachment are also possible), and the upraised dome structure 32 increases the rigidity of the embedded connection, while the corresponding recessed dome structure 34 permits the piston 16 to execute a full stroke by accommodating the upraised dome structure 32 at the top of the stroke. Additionally, the first end of the cylinder 12 is provided with at least one, and preferably more than one, air passages 36 for admitting air to the portion of the chamber 14 above the piston 16.

The cylinder 12 is itself composed of three integral sections: a first preferably substantially cylindrical section 38, a second preferably substantially cylindrical section 40, and a radially tapering section 42 positioned between the first and second sections 38 and 40, respectively. The first cylinder section 38 is of substantially greater transverse dimension as compared to the second cylinder section 40, and the radially tapering intermediate cylinder section 42 provides a smooth transition between the first and second cylinder sections 38 and 40, respectively. The first cylinder section 38 surrounds the chamber 14, the second cylinder section 40 surrounds the first channel portion 26, and the radially tapering intermediate cylinder section 42 surrounds the second channel portion 28.

The second end of the cylinder 12 is provided with a collar member 44 that preferably frictionally fits thereover. The collar member 44 includes an annular shaped portion 46 that engages the second end of the cylinder 12 and a frustum shaped portion 48 that extends outward from the annular shaped portion 46, preferably projecting beyond the second end of the cylinder 12. The collar member 44 is preferably constructed from a relatively flexible material, such as, for example, a hard rubber or a semiflexible elastomeric. The distal end of the frustum shaped portion 48 of the collar member 44 is provided with another opening 50.

Figure 2:
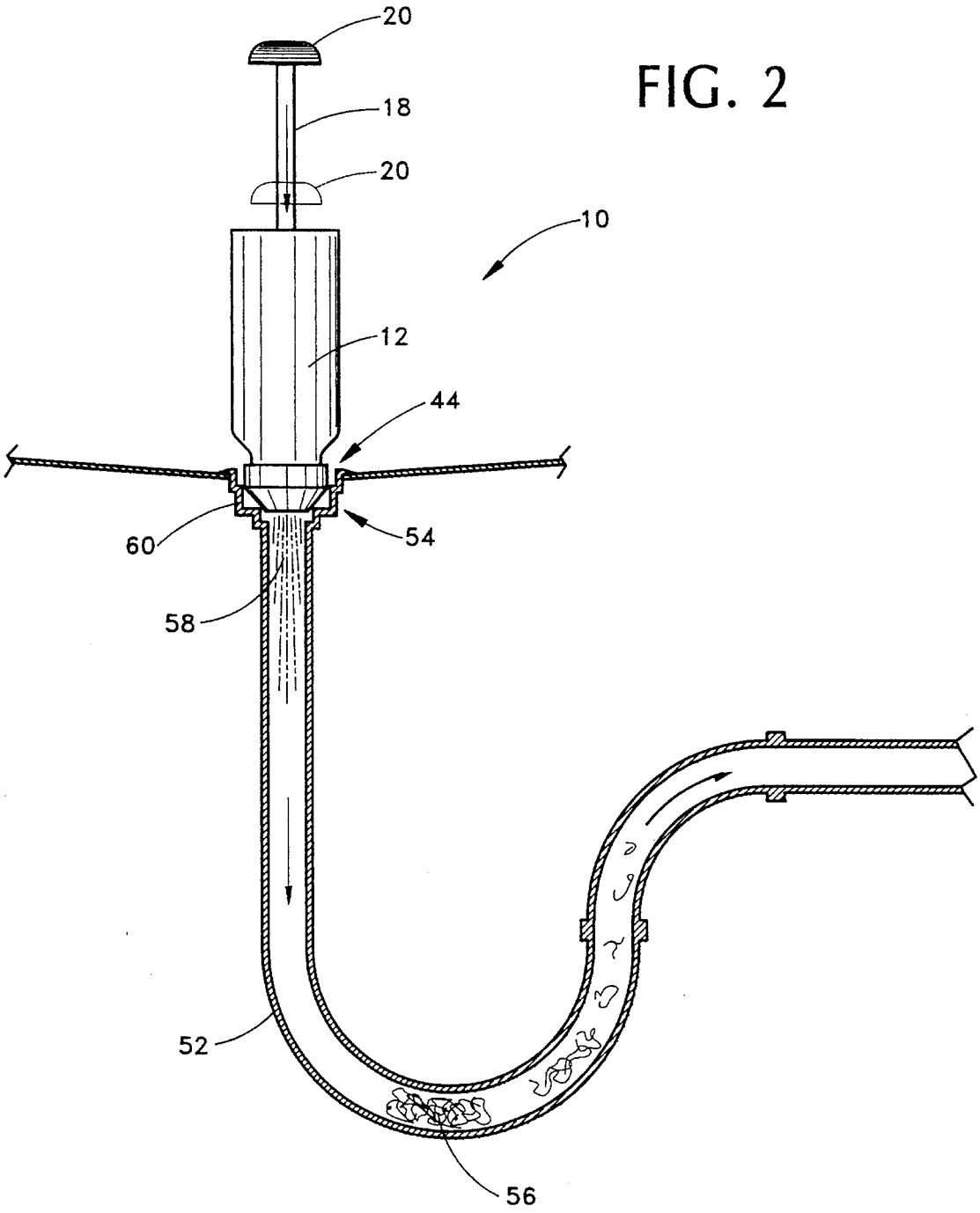
FIG. 2 is an illustration showing the inventive water plunger in operation.

The particular construction of the collar member 44 provides a secure airtight and watertight fit between the water plunger 10 and the drain fitting of a drain pipe, as shown in FIG. 2, where there is illustrated a drain pipe 52 having a drain fitting 54 and obstructed by a clog 56. The drain fitting 54, of generally conventional design, normally includes a drain opening 58 and an upstanding peripheral wall 60 surrounding and spaced radially outward from the drain opening 58. The collar member 44 of the water plunger is preferably dimensioned such that the annular shaped portion 46 thereof will engage the upstanding peripheral wall 60, while the frustum shaped portion 48 sealingly engages the drain opening 58. To this end, the outer diameter of the annular shaped portion 46 is preferably on the order of about three inches, and the outer diameter of the frustum shaped portion 48 tapers in from about three inches to about one and one half inches.

Other preferred dimensions of construction are that the overall length of the cylinder be about 12 inches, that the length of the chamber 14 (e.g., the stroke of the piston) be about 9 inches, and that the combined length of the first and second channel sections 26 and 28, respectively, be on the order of about 2 inches.

In operation, the second end of the cylinder 12 is preferably inserted into standing water in a basin (e.g., a sink) and the piston 16 is moved upward via the piston handle 18 to fill the chamber 14 and the first and second channel sections 26 and 28 with water. The collar member 44 is then pressed against the drain fitting 54, substantially as shown in FIG. 2, and the piston 16 is forced downward to expel the water into the drain pipe 52 under pressure. The converging geometry of the second channel section 28 produces an accelerated surge of water through the drain pipe 52. The process may be repeated as needed.

It is not necessary that the drain pipe 52 be equipped with the type of drain fitting 54 shown in FIG. 2 for the water plunger 10 to be effective. The frustum shaped section 48 of the collar member 44 can achieve a suitable sealing action with drain openings having diameters that range between the outer diameter of the annular shaped section 46 and the outer diameter of the distal end of the frustum shaped section 48, that is, in the preferred embodiment presented herein, between about three inches and about one and one half inches. Of course, collar members having other dimensions can be provided for drain openings having different dimensions.

While the invention has been herein described by way of a particular preferred embodiment, various substitutions of equivalents may be effected without departing from the spirit and scope of the invention as set forth in the following claims.

What is claimed is:

1. A plunger for clearing a drain pipe, the drain pipe terminating in a drain fitting, said plunger comprising:

an elongated cylinder having a first end and a second end;

an elongated chamber disposed within said elongated cylinder;

a piston disposed within said elongated chamber;

a piston handle attached to said piston and projecting from a first end of said elongated chamber;

said piston being slidable in a reciprocal fashion within said elongated chamber by movement of said piston handle;

said piston including an upraised dome structure located on an upper surface thereon:

said elongated cylinder including a recessed dome structure located on an interior surface of said first end of said elongated cylinder, said recessed dome structure mating with said upraised dome structure;

a channel extending from said elongated chamber to said second end of said elongated cylinder;

said channel terminating in an opening in said second end of said elongated cylinder;

said opening being of a substantially smaller transverse dimension than said elongated chamber;

said channel tapering inward as it extends from said elongated chamber to said opening; and a collar member substantially surrounding said opening, said collar member comprising a substantially flexible material.

2. A plunger according to claim 1, wherein said collar member comprises a substantially annular portion surrounding said second end of said elongated cylinder and said opening provided therein, and an inwardly tapering portion extending outward from said annular portion.

3. A plunger according to claim 2, wherein said collar member consists essentially of an elastomeric material.

4. A plunger according to claim 3, wherein said plunger additionally comprises at least one air passage extending from said elongated chamber to said first end of said elongated cylinder.

5. A plunger according to claim 4, wherein the drain basin fitting includes a drain opening and at least one substantially upstanding peripheral wall surrounding and spaced radially outward from the drain opening, wherein said inwardly tapering portion of said collar member terminates in a distal terminal end, said distal terminal end having an outer diameter substantially equal to the diameter of the drain opening, and wherein the outer diameter of said substantially annular portion is substantially equal to the diameter of the at least one substantially upstanding peripheral wall.

6. A plunger for clearing a drain pipe, the drain pipe terminating in a drain basin fitting, the drain basin fitting including a drain opening and at least one substantially upstanding peripheral wall surrounding and spaced radially outward from the drain opening, said plunger comprising:

an elongated cylinder having a first end and a second end;

an elongated chamber formed in said elongated cylinder;

a piston member disposed within said elongated chamber for reciprocating movement therewithin;

said piston member including an upraised dome structure located on an upper surface thereon;

said elongated cylinder including a recessed dome structure located on an interior surface of said first end of said elongated cylinder, said recessed dome structure mating with said upraised dome structure;

a piston handle attached to and extending from said piston member through said first end of said elongated cylinder;

said channel comprising a first channel portion surrounded by a substantially cylindrical peripheral wall and a second channel portion surrounded by a substantially conical peripheral wall, said substantially conical peripheral wall tapering radially inward in the direction of said second end of said elongated cylinder;

said first channel portion terminating in an opening provided at said second end of said elongated cylinder;

said second channel portion being disposed intermediate between said elongated chamber and said first channel portion; and a collar member, said collar member comprising:

a substantially annular shaped portion surrounding said opening; and a substantially frustum shaped portion extending outward from said substantially annular shaped portion and terminating in a distal terminal end;

the outer diameter of said substantially annular shaped portion being substantially equal to the diameter of the at least one substantially upstanding peripheral wall;

the outer diameter of said distal terminal end of said substantially frustum shaped portion being substantially equal to the diameter of the drain opening; and said collar member consisting essentially of a substantially flexible material.

* * * * *